US008698027B2

(12) United States Patent
Anderst

(10) Patent No.: US 8,698,027 B2
(45) Date of Patent: Apr. 15, 2014

(54) PUSHBUTTON SWITCH

(75) Inventor: Scott Anderst, Forest Lake, MN (US)

(73) Assignee: Stencil Cutting and Supply Co., Inc., Red Wing, MN (US)

( * ) Notice: Subject to any disclaimer, the term of this patent is extended or adjusted under 35 U.S.C. 154(b) by 299 days.

(21) Appl. No.: 13/198,273

(22) Filed: Aug. 4, 2011

(65) Prior Publication Data

US 2013/0032458 A1 Feb. 7, 2013

(51) Int. Cl.
*H01H 3/12* (2006.01)

(52) U.S. Cl.
USPC ..... 200/341; 200/345

(58) Field of Classification Search
USPC ..... 200/341, 345, 293, 295–296, 330
See application file for complete search history.

(56) References Cited

U.S. PATENT DOCUMENTS 4,114,001 A * 9/1978 Corfield ..... 200/50.06
4,297,556 A * 10/1981 Taylor ..... 200/330
4,499,352 A * 2/1985 Fujita et al. ..... 200/296
5,389,758 A 2/1995 Agnatovech
5,401,925 A * 3/1995 Sambar ..... 200/296
5,508,485 A 4/1996 Nishikawa
6,102,394 A * 8/2000 Wurz et al. ..... 273/138.2
6,191,376 B1 2/2001 Bartok
6,550,586 B1 4/2003 Takeuchi
6,998,553 B2 * 2/2006 Hisamune et al. ..... 200/336
7,329,821 B2 2/2008 Tan
7,683,278 B2 3/2010 Kakita et al.
7,963,003 B1 * 6/2011 Keene ..... 16/441

* cited by examiner

*Primary Examiner* — Xuong Chung Trans
(74) *Attorney, Agent, or Firm* — C.G. Mersereau, Nikolai & Mersereau, P.A.

(57) ABSTRACT

A pushbutton switch assembly includes a molded housing body with an integral central barrel, a pushbutton mounted in the housing body and having a stem plunger received in and longitudinally movable in the barrel with the operation of the pushbutton and a return spring for returning the pushbutton to a normal position when it is depressed and released. The central barrel and plunger are of a matching non-round shape thereby preventing rotation of the button in relation to the housing.

12 Claims, 3 Drawing Sheets

PUSHBUTTON SWITCH

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates generally to pushbutton switch devices and, more particularly, to pushbutton switch devices in which electrical contact is made in a control circuit when the switch plunger is advanced. The switch provides a momentary signal in a circuit that initiates an action which continues after the momentary push of the button has been released. Many coordinated switches may be mounted in a panel array with corresponding pushbuttons such as in elevator controls and, specifically, the switch devices of the invention feature mounting elements that insure proper alignment and are configured to prevent rotation of the pushbutton relative to the housing.

II. Related Art

A variety of pushbutton switch devices have been developed in which a pushbutton is connected to a central plunger that is longitudinally moveable in a barrel to contact and momentarily connect and thereby activate a control circuit upon depressing the plunger and in which contact is broken upon release and retraction of the pushbutton and plunger. Such switches find utility a variety of applications in which the pushbutton switch provides activation for a momentary signal to a circuit that initiates some action which continues after a momentary push of the button has been released. Such a sequence is well known. For example, in elevator controls where pushbuttons associated with each floor are used to log in and activate the operation of the elevator accordingly.

Such pushbutton switches are known which may have a construction which precludes or controls rotation of the pushbutton in its housing. Such a device is shown, for example, in U.S. Pat. No. 6,191,376 B1 to Bartok in which spaced lugs engage splines with a ratchet to index rotation of the pushbutton to alternately connect and disconnect a circuit.

Many other pushbuttons of the class are constructed so that the pushbutton and plunger are free to rotate at random. In addition, such prior devices require periodic lubrication to assure continued operation.

Thus, there remains a need for a simple, but long life, pushbutton switch actuating device which includes an anti-rotation feature and which does not require lubrication for the life of the pushbutton.

SUMMARY OF THE INVENTION

The present invention is directed to embodiments of a pushbutton switch assembly having a pushbutton element designed to be depressed and released, the button springing back to a normal position immediately after release. The momentary signal to a circuit provided by the pushbutton is designed to initiate a remote action such as the operation of an elevator rather than just a local result.

A preferred embodiment includes a housing body which is provided with a fixed hollow central barrel and a pushbutton member mounted in the housing body that includes a stem plunger, the pushbutton being longitudinally moveable relative to the housing body and the plunger moveable longitudinally in the fixed barrel when the pushbutton is operated. A return spring is mounted in the housing body that causes the pushbutton, when depressed and released, to return to an outward or normal position. The central barrel and plunger are of a matching non-round shape that fixes the rotational disposition of the pushbutton relative to the housing body preventing unwanted rotation of the pushbutton element such that any label on the pushbutton remains at a desired orientation relative to an associated panel in which the pushbutton may be mounted.

The pushbutton assembly housing body is preferably formed from an injection-molded self-extinguishing plastic material that may have outer threads for panel mounting and may be provided with integral extending spaced resilient hooks that removably snap-fit into compatible circuit modules operable by the pushbutton switch. The pushbutton switch assembly further includes elements to fasten the assembly to a panel member having a sized cut-out. These may include a sealing O-ring, spacer washer and nut which threads onto the outer threads of the housing body.

The pushbutton itself may be of stainless steel and the operation of the pushbutton relative to the housing and including a metal plunger which operates relative to a fixed central barrel, enables the pushbutton switch of the invention to be one which requires no lubrication over the life of the pushbutton. The pushbutton switch itself may have an outward configuration selected from plane and dome shapes and may be provided with numbers, raised lettering or Braille notations.

The housing may also be provided with alignment devices for aligning the pushbutton initially relative to a mounting panel. These may be in the form of small raised nubs in the outer surface of the pushbutton switch housing body which match indentations or dimples on the mounting panel.

BRIEF DESCRIPTION OF THE DRAWINGS

In the drawings, wherein like numerals designate like parts throughout the same.

DETAILED DESCRIPTION

The following description details one or more exemplary embodiments illustrating the concepts of the present invention. It should be noted that the detailed description is intended by way of example only and is not intended to limit the scope of the invention in any respect. It will be further understood that the embodiments of the invention can be modified by those skilled in the art while remaining in keeping with the inventive concepts.

Figure 1A:
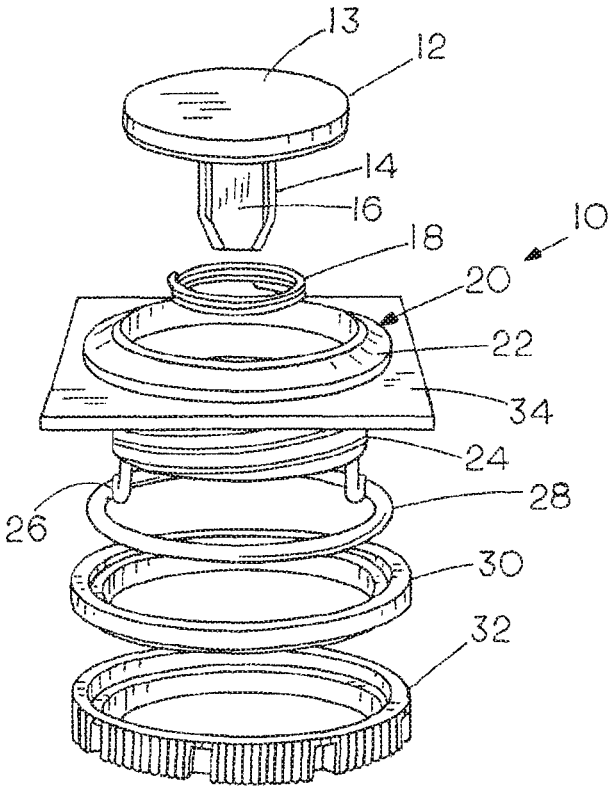
FIG. 1A is an exploded perspective view of a pushbutton switch assembly in accordance with the invention.
Figure 1C:
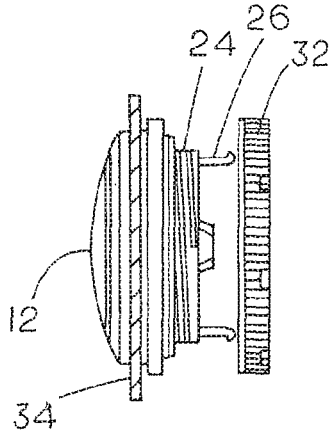
FIGS. 1B and 1C are reduced top and side views, respectively, of the pushbutton switch assembly of FIG. 1A.
Figure 1D:
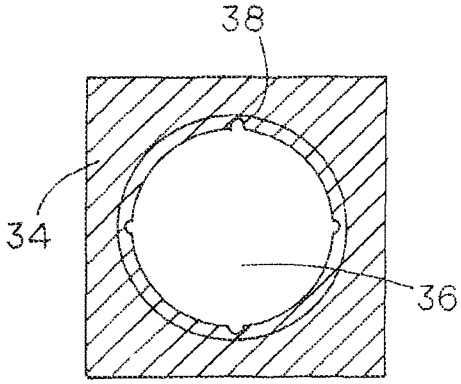
FIG. 1D shows a typical cut-out for the assembling pushbutton switch assembly of FIGS. 1A-1C into a panel.
Figure 1B:
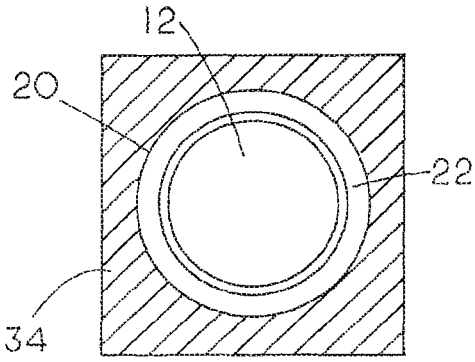

FIGS. 1A-1C depict an exploded perspective view of a pushbutton switch assembly in accordance with the invention, shown generally at 10. The pushbutton switch assembly includes a pushbutton or target element 12 having a dome-shaped surface 13 and incorporating a non-round stem plunger 14 with flattened side 16. A return spring element 18, molded housing body, generally 20, which includes a collar 22, which may be captured in the molded housing body, threaded section 24 and spaced extending resilient hooks 26. Assembly parts also include an O-ring donut 28, a spacer washer 30 and a threaded nut 32 for fastening the pushbutton assembly into a panel. A mounting plate is represented at 34. As shown best in FIG. 1D, a cut-out pushbutton mounting opening is shown at 36 with a series of small alignment recesses or dimples at 38.

Figure 2A:
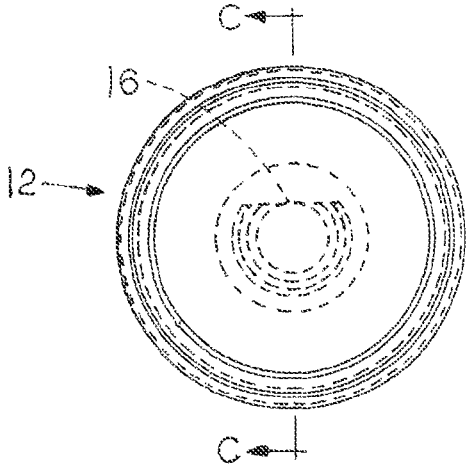
FIGS. 2A and 2B are top and side views, respectively, of a pushbutton member in accordance with the invention.
Figure 2B:
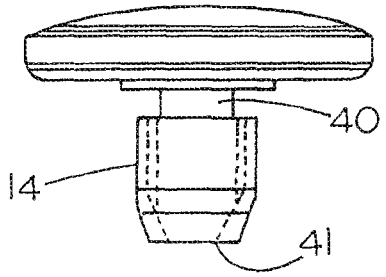
Figure 3B:
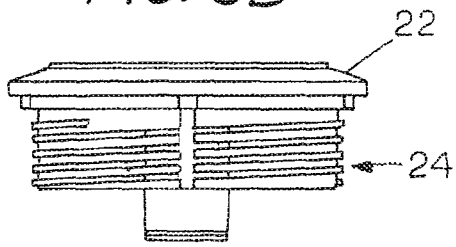
FIGS. 3A, 3B and 3C are top, side and bottom views, respectively, of a pushbutton switch housing body in accordance with the embodiment of FIGS 1A-D.
Figure 2C:
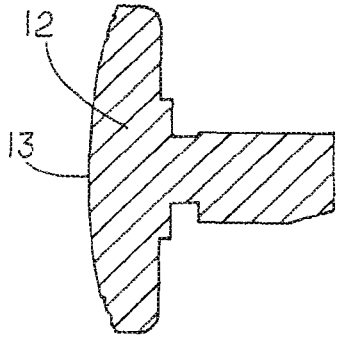
FIG. 2C is a sectional view along line C-C of FIG. 2A.
Figure 3C:
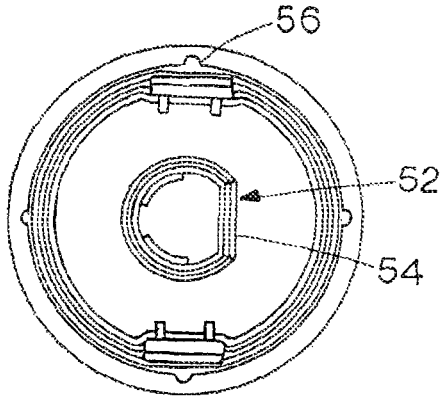
Figure 3A:
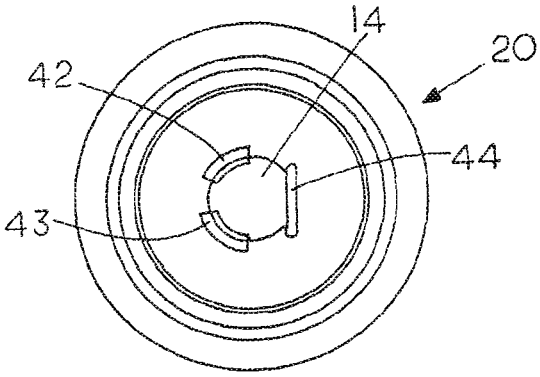
Figure 3D:
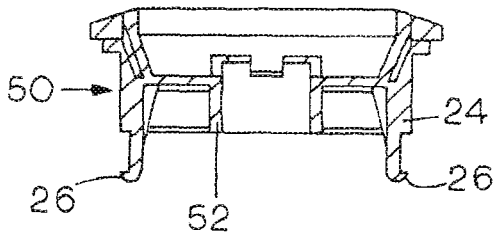
FIG. 3D is a sectional view along line D-D of FIG. 3B.

The pushbutton or target element 12 is shown in greater detail in FIGS. 2A-2C. Note that there is a neck-down section shown at 40 and a tapered section at 41. As shown in the figures, the housing body 20 includes three hook members 42, 43 and 44 which are resilient enough to accommodate and retain the non-round stem plunger 14 in the housing in the manner of a removable snap fit.

FIGS. 3A-3D show details of housing body 20, including collar 22 which may be of navel brass or stainless steel. The outer body portion of the housing body, shown at 50, including the threaded portion 24 and hooks 26, is preferably made of injection molded plastic. The central barrel is shown at 52, which is of a shape and size to match the outer periphery of the stem plunger element 14 and includes flat side 54. Alignment nubs are shown at 56, which are designed to match the alignment recesses 38 shown in FIG. 1D.

It should be noted that the injection molded pushbutton switch assembly body element is preferably made of a readily moldable plastic material which is also one which self-extinguishes in case the pushbutton assembly is involved in a fire, either electrical or otherwise. Such materials are, for example, polycarbonate, PC-ABS. In addition, the pushbutton itself may be made of any compatible material, but is preferably of stainless steel and is designed such that pushbutton and stem plunger move relative to a fixed barrel arrangement in the housing body, as shown in the drawings, such that no additional lubrication is necessary, as is the case with many button designs. In addition, the pushbutton assembly of the present invention is designed to meet the standards of the American National Standards Institute as applied to these devices.

Figure 4:
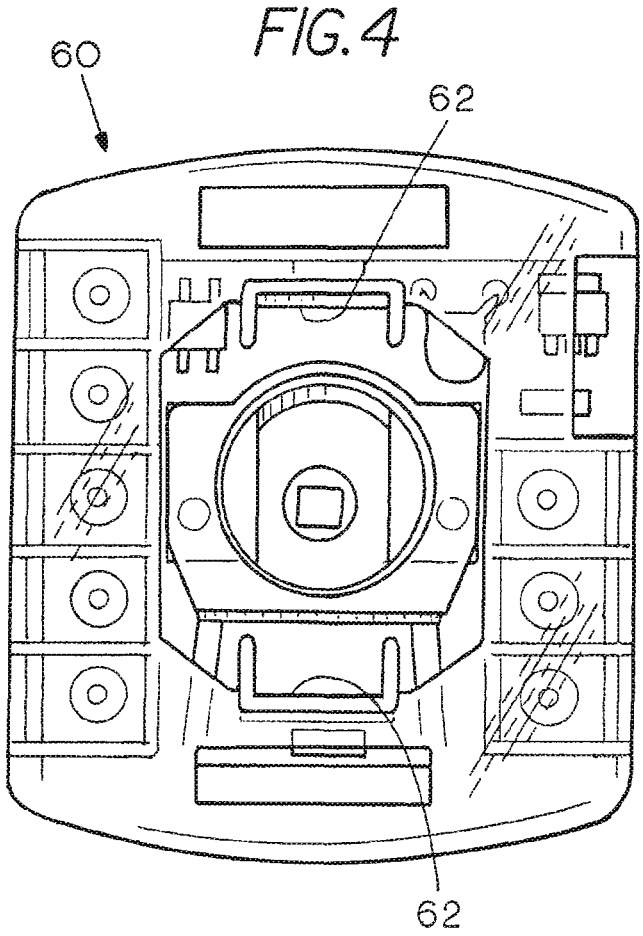
FIG. 4 is a typical circuit module operable using the pushbutton switch assembly of the invention.

FIG. 4 depicts a typical circuit module designed to receive a pushbutton such as that of the present invention and has a pair of spaced flanges 62 designed to receive the resilient hooks 26 of the pushbutton assembly of the present invention.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A pushbutton switch assembly comprising:

(a) a housing body including an integral central barrel;

(b) a pushbutton mounted in and operable with respect to said housing body and having a stem plunger received in and longitudinally movable in said barrel with the operation of said pushbutton;

(c) a return spring for returning said pushbutton to a normal position when it is depressed and released;

(d) wherein said central barrel and said plunger are of a matching non-round shape thereby preventing rotation of said button in relation to said housing (e) wherein said housing further comprises an alignment member that cooperates with, and prevents rotation of said housing in relation to, a mounting plate.

2. A pushbutton switch assembly as in claim 1 wherein said central barrel of said housing body and said plunger are of materials which operated together need no lubrication.

3. A pushbutton switch assembly as in claim 1 wherein said pushbutton and plunger are stainless steel.

4. A pushbutton switch assembly as in claim 1 wherein said housing body includes an injection molded plastic material.

5. A pushbutton switch assembly as in claim 2 wherein. said pushbutton and plunger are stainless steel and wherein said housing body includes an injection molded plastic material.

6. A pushbutton switch assembly as in claim 1 further comprising an O-ring, a spacer washer and nut for assembling said pushbutton into a panel button cut-out.

7. A pushbutton switch assembly as in claim 1 wherein said housing body comprises spaced resilient hooks for snap-fitting into a corresponding circuit assembly module.

8. A pushbutton switch assembly as in claim 1 wherein said housing body includes alignment means for aligning said pushbutton switch relative to a panel.

9. A pushbutton switch assembly; as in claim 1 wherein said pushbutton profile is selected from plane and dome shapes.

10. A pushbutton switch assembly as in claim 4 wherein said plastic material is self-extinguishing.

11. A pushbutton switch assembly as in claim 5 wherein said plastic material is self-extinguishing.

12. A pushbutton switch assembly as in claim 8 wherein said alignment means comprises matching nubs and recesses.

* * * * *